US007565709B2

(12) United States Patent
Davis

(10) Patent No.: US 7,565,709 B2
(45) **Date of Patent: *Jul. 28, 2009**

(54) DOUBLE CHAMBERED AIR MATTRESS

(75) Inventor: David T. Davis, Bethlehem, PA (US)

(73) Assignee: Woodlark Circle, Inc., Bethlehem, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/103,517

(22) Filed: Apr. 15, 2008

(65) Prior Publication Data

US 2008/0189866 A1 Aug. 14, 2008

Related U.S. Application Data

(63) Continuation of application No. 11/532,132, filed on Sep. 15, 2006, now Pat. No. 7,376,995, which is a continuation-in-part of application No. 11/191,674, filed on Jul. 28, 2005, now Pat. No. 7,107,641.

(60) Provisional application No. 60/592,251, filed on Jul. 28, 2004.

(51) Int. Cl.
*A47C 27/10* (2006.01)
*A61G 7/14* (2006.01)

(52) U.S. Cl. ..... 5/710; 5/711; 5/81.1 HS

(58) Field of Classification Search ..... 5/710–715, 5/81.1 HS, 644
See application file for complete search history.

(56) References Cited

U.S. PATENT DOCUMENTS

| | | | | |
|---|---|---|---|---|
| 2,542,781 | A | 2/1951 | Sawyer | 5/348 |
| 4,225,989 | A | 10/1980 | Corbett et al. | 5/453 |
| 4,517,690 | A | 5/1985 | Wegener | 5/81 R |
| 4,528,704 | A | 7/1985 | Wegener et al. | 5/81 R |
| 4,686,719 | A | 8/1987 | Johnson et al. | 5/81 R |
| 5,067,189 | A | 11/1991 | Weedling et al. | 5/81 R |
| 5,423,094 | A | 6/1995 | Arsenault et al. | 5/455 |
| 5,483,709 | A | 1/1996 | Foster et al. | 5/81.1 |
| 5,535,463 | A | 7/1996 | Chiu | 5/452 |
| 5,561,873 | A | 10/1996 | Weedling | 5/711 |
| 5,598,593 | A | 2/1997 | Wolfe | 5/710 |
| 5,860,174 | A | 1/1999 | Failor | 5/81.1 HS |
| 6,073,291 | A | 6/2000 | Davis | 5/711 |
| 6,148,461 | A | 11/2000 | Cook et al. | 5/713 |
| 6,467,106 | B1 | 10/2002 | Heimbrock | 5/81.1 C |
| 6,618,884 | B1 | 9/2003 | Wu | 5/706 |
| 6,671,910 | B2 | 1/2004 | Hsu et al. | 5/710 |
| 6,701,559 | B2 | 3/2004 | Boso et al. | 5/739 |
| 6,996,867 | B2 | 2/2006 | Boso et al. | 5/739 |
| 7,107,641 | B2 | 9/2006 | Davis | 5/710 |
| 2004/0226101 | A1 * | 11/2004 | Lin et al. | 5/710 |

* cited by examiner

*Primary Examiner*—Michael Trettel
(74) *Attorney, Agent, or Firm*—Duane Morris LLP

(57) ABSTRACT

A double chambered transfer mattress is provided capable of partial deflation that that includes a top inflatable mattress and a bottom inflatable mattress that are separated by a common wall from one another. A selectable inlet/outlet valve is arranged for airflow communication between an interior chamber of the bottom inflatable mattress and a source of pressurized air. A one-way valve is positioned through the common wall so as to provide selective air flow communication between the top inflatable mattress and the bottom inflatable mattress so that when the inlet/outlet valve is closed, so that air continues to escape from perforations in the bottom inflatable mattress, the one-way valve is actuated so as to prevent deflation of the top inflatable mattress.

7 Claims, 3 Drawing Sheets

DOUBLE CHAMBERED AIR MATTRESS

CROSS-REFERENCE TO RELATED APPLICATIONS

This application is a continuation application of U.S. application Ser. No. 11/532,132, filed on Sep. 15, 2006, now issued as U.S. Pat. No. 7,376,995, the entirety of which is incorporated herein by reference, which itself is a continuation-in-part application of U.S. application Ser. No. 11/191,674 filed Jul. 28, 2005, now issued as U.S. Pat. No. 7,107,641, which itself claimed priority from Provisional Patent Application No. 60/592,251 filed Jul. 28, 2004.

FIELD OF THE INVENTION

The present invention generally relates to patient transfer devices and, more particularly to a patient transfer apparatus which employs an air bearing to facilitate the transfer.

BACKGROUND OF THE INVENTION

Patient handling mattresses are known in the art which include at least two flexible material sheets, that together define a plenum chamber, with at least one sheet being perforated with small pinholes over at least a central surface area, and which open up directly to the interior of the plenum chamber. Such prior art mattresses are used by arranging the perforated sheet so that it faces an underlying fixed, generally planar support surface, such as a floor or table. When the mattress is charged with pressurized air, the escape of air under pressure through the pinholes acts initially to jack a load placed upon the mattress above the perforated flexible sheet, and thereby creates an air bearing of relatively small height between the underlying fixed, generally planar support surface and the perforated flexible sheet.

For example, in U.S. Pat. No. 4,517,690, issued to Wegener, an air pallet is disclosed that is formed from upper and lower thin flexible film sheets sealed at their edges to form a plenum chamber. Wegener's air pallet functions to move a load with minimal friction over an underlying generally planar fixed support surface. The bottom thin flexible material sheet is perforated by small diameter perforations such as pin holes at the load imprint area.

In U.S. Pat. No. 5,561,873, issued to Weedling, provides an inflatable flexible pallet within which an array of structurally interrelated inflatable chambers are formed to support a load when inflated. The flexible pallet is configured to resist lateral and longitudinal shrinkage of the load support surface, as well as ballooning and hot dogging. Rotational instability is also reduced by providing a greater load surface support area.

In U.S. Pat. No. 6,073,291, issued to Davis, an inflatable medical patient transfer apparatus is disclosed that has a combination of transverse partition members and a raised perimeter section to reduce deleterious ballooning and uneven inflation as well as quick emergency deflation. Additional differentially inflatable patient rolling chambers are disclosed on the top of the transfer apparatus to provide assistance to medical personnel in beginning to roll patients reclining or lying upon the transfer apparatus, particularly in a deflated condition on a hospital bed.

All of the foregoing devices have suffered from an inability to be used during X-ray imaging of a patient lying upon the mattress. Proper X-ray imaging requires that the patient remain motionless during the exposure. Prior art transfer mattresses tend to drift or move, and are easily moved by even small perturbations. Thus, they are required to be deflated prior to effecting X-ray imaging of the patient. Unfortunately, when deflated, the patient is forced to lie upon a very stiff table that can be quite uncomfortable for heavier patients.

Many of the foregoing devices also suffer from the fact that when uninflated they tend to bunch causing photo images to appear upon the x-ray exposures that mask underlying physiological features of the patient. There is a continuing need to be able to easily and safely x-ray a patient on an inflated transfer mattress.

SUMMARY OF THE INVENTION

The present invention provides a double chambered transfer mattress that is capable of partial deflation. In one embodiment, a transfer mattress is provided that includes a top inflatable mattress and a bottom inflatable mattress that are separated by a common wall from one another. The bottom inflatable mattress includes a plurality of holes or perforations disposed in a bottom panel. A selectable inlet/outlet valve is arranged for airflow communication between an interior chamber of the top inflatable mattress and a source of pressurized air. A one-way valve is positioned through the common wall so as to provide selective air flow communication between the top inflatable mattress and the bottom inflatable mattress so that when said inlet/outlet valve is closed-off from the source of pressurized air, the bottom inflatable mattress deflates by air escaping through the plurality of holes or perforations whereby the one-way valve is actuated so as to prevent deflation of the top inflatable mattress.

In another embodiment a top sheet is provided having a width, a length, and peripheral edges, an intermediate, barrier sheet having the same width, the same length, and peripheral edges, and a bottom sheet having the same width, the same length, peripheral edges and a plurality of perforations. A first perimeter band is sealingly fastened between the peripheral edges of the top and barrier sheets and a second perimeter band is sealingly fastened between the peripheral edges of the barrier and bottom sheets. The peripheral edges of the top, barrier, and bottom sheets are sealingly fastened to the respective perimeter bands by heat sealing. A plurality of baffles, each having a width and a length, are attached to an inner surface of the top sheet and the barrier sheet so as to be oriented between the top sheet and the barrier sheet. A second plurality of baffles, each having a width and a length, are attached to an inner surface of the barrier sheet and an inner surface of the bottom sheet so as to be oriented between the barrier sheet and the bottom sheet. One or more inlet/outlet openings are located within the perimeter bands so that the double chambered transfer mattress may be inflated or deflated. Advantageously, one or more one-way valves are located through the barrier sheet so as to provide selective air flow communication between a first chamber formed between the top sheet, the barrier sheet, and the first perimeter band and a second chamber formed between the barrier sheet, the bottom sheet, and the second perimeter band. In this way, an inlet/outlet located in the first perimeter band may be closed-off from the source of pressurized air so that the second chamber deflates by air escaping through the plurality of holes or perforations. As the second chamber deflates, the one or more one-way valves are actuated so as to present deflation of the first chamber.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
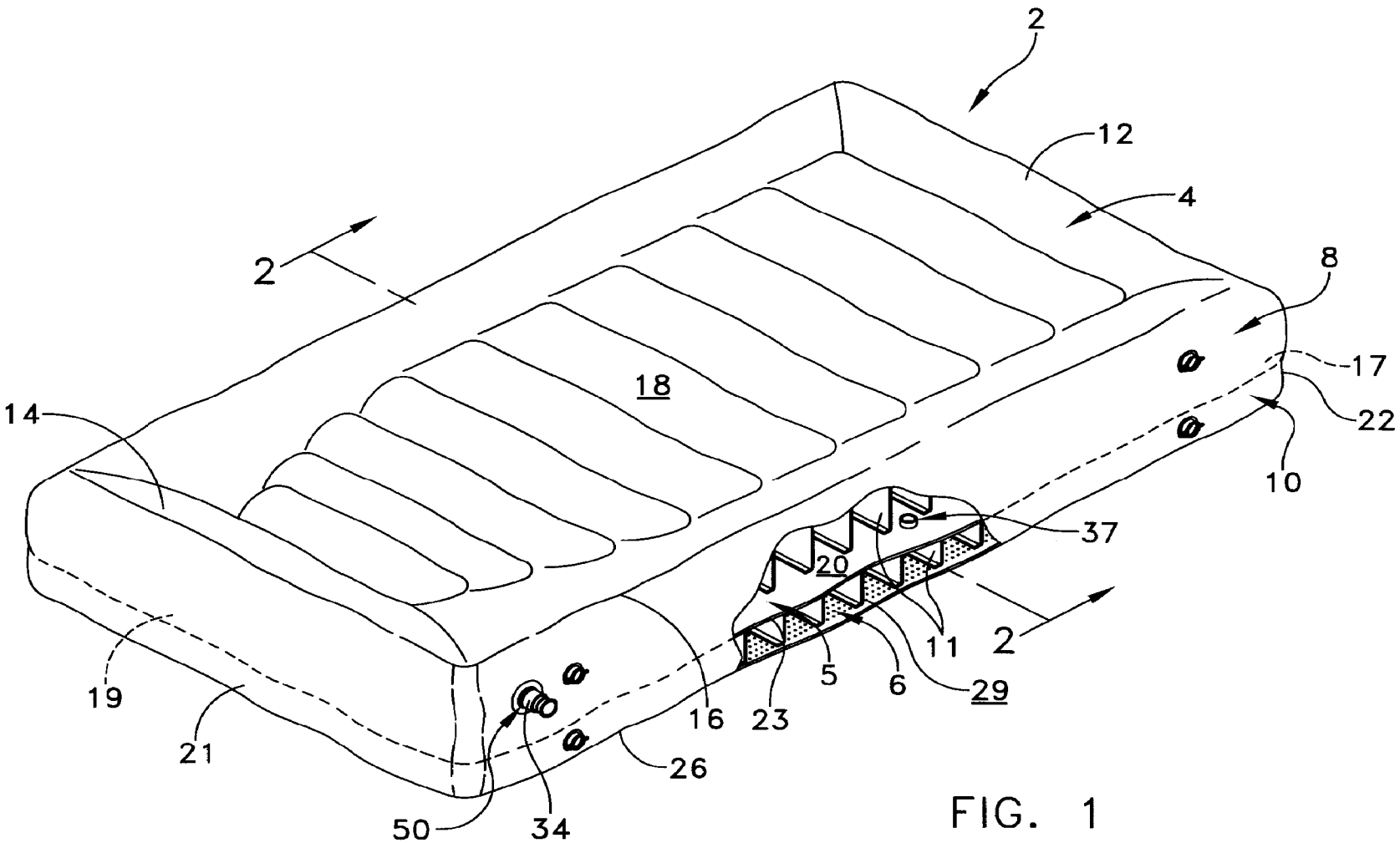
FIG. 1 is a perspective view of a double chambered transfer mattress formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Figure 2:
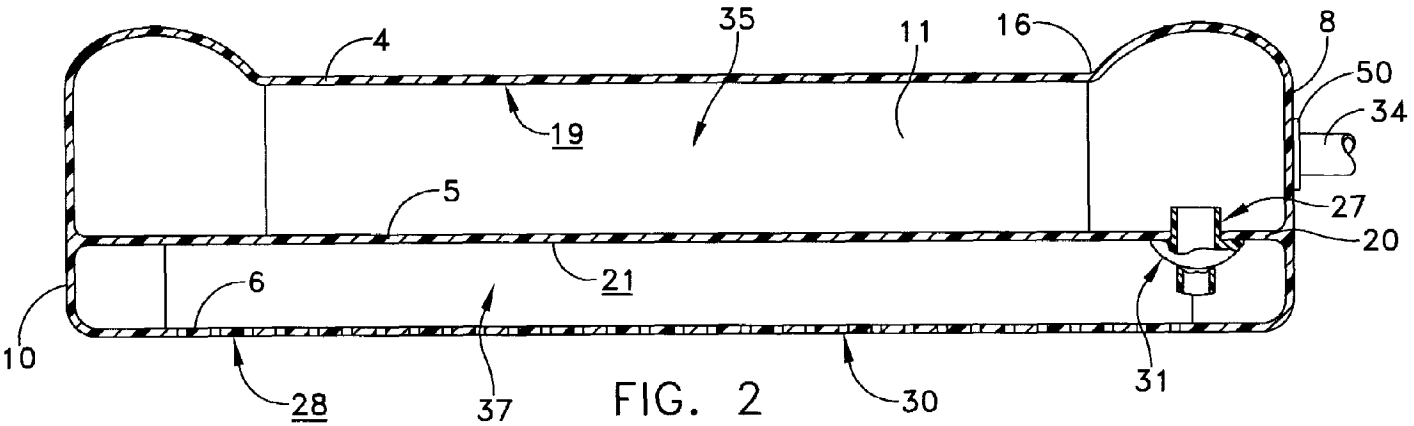
FIG. 2 is a cross-sectional view of the transfer mattress shown in FIG. 1.
Figure 3:
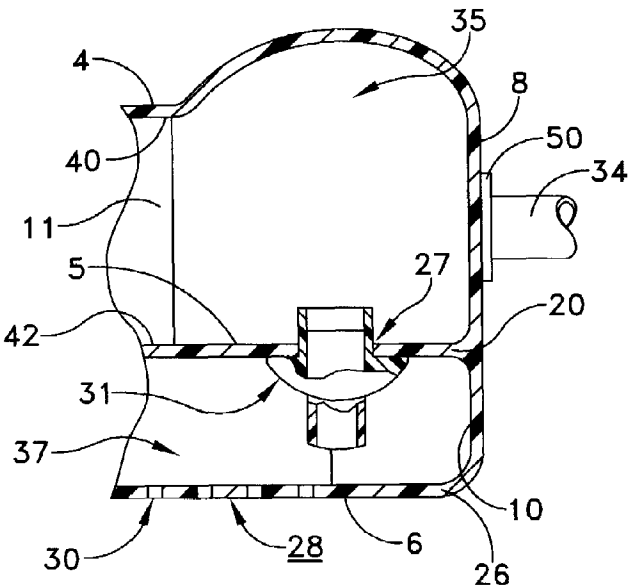
FIG. 3 is a broken-away, cross-sectional view of a portion of FIG. 2.
Figure 4:
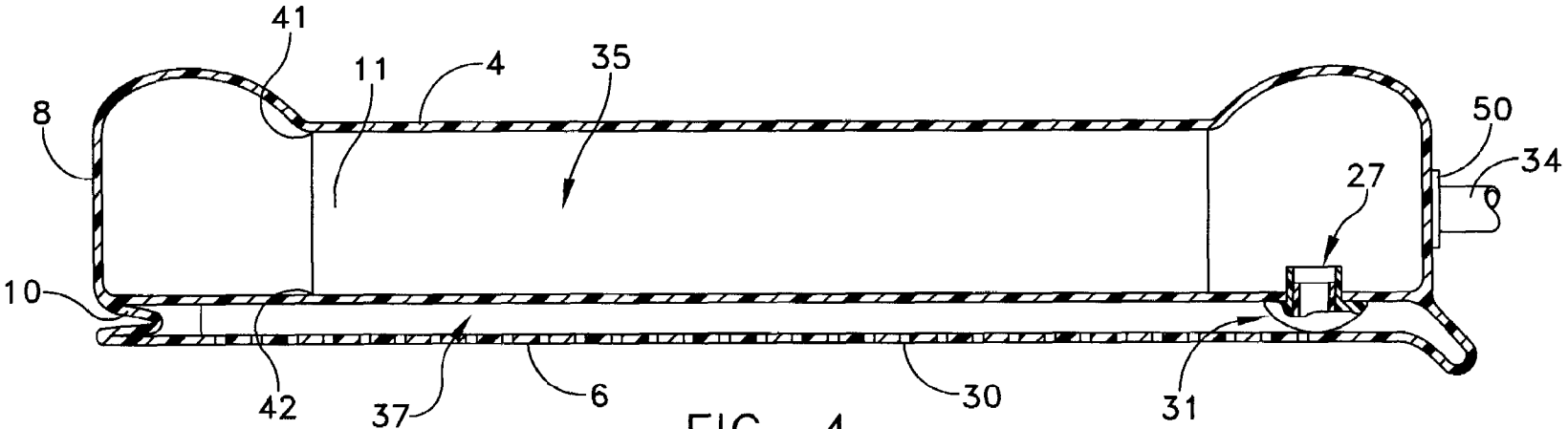
FIG. 4 is a cross-sectional view of the double chamber transfer mattress shown in FIG. 2, with the second chamber deflated and the mushroom valve actuated to a closed position.
Figure 5:
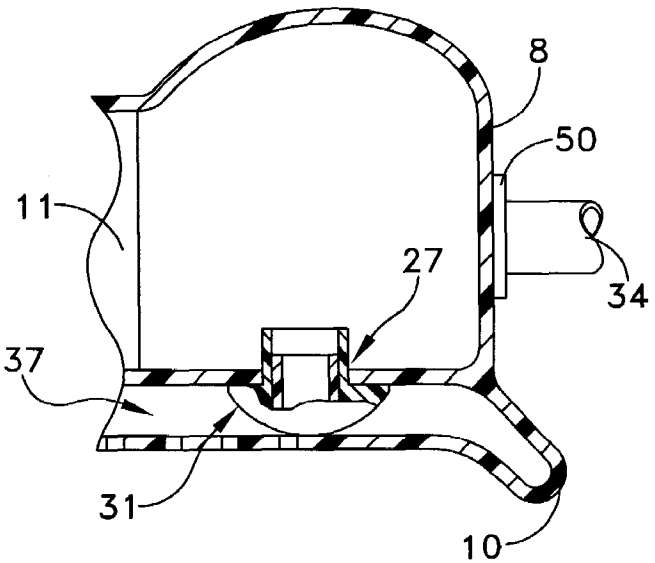
FIG. 5 is a broken-away, cross-sectional view of a portion of FIG. 4.

Referring to FIGS. 1-5, a double chambered transfer mattress 2 formed in accordance with the present invention comprises a top panel 4, an internal barrier panel 5, a bottom panel 6, a top perimeter band 8, a bottom perimeter band 10, and a plurality of baffle-panels 11. More particularly, top panel 4 comprises a head portion 12, a foot portion 14, and a peripheral edge 16. Top panel 4 is formed from a sheet of fabric, e.g., nylon scrim or the like, that may be coated on at least its outer surface 18 with a water proof coating. Inner surface 19 of top panel 4 may also be coated with a water proof coating as well. The water proof coating may be any of the well known polymeric or elastomeric compounds that are known to be impervious to semi-solids and liquids, such as, blood, urine, feces, hospital strength disinfecting compounds, alcohol, or the like. For example, a nylon twill fabric that is coated on one side with a heat sealable, polyurethane coating (e.g., an inner side) and the outer side coated with a Durable Water Repellant (patient side). The presence of polyurethane on the interior surfaces allows for heat sealing, eliminating needle holes.

Barrier panel 5 comprises a head portion 17, a foot portion 19, a top inner surface 20, a bottom inner surface 21, and a peripheral edge 23, and is often formed from a sheet of fabric, e.g., nylon scrim or the like. One or more openings 27 are defined through the peripheral side surface of barrier panel 5 so as to provide for air flow communication. In one embodiment of the invention, a one way valve 31 is positioned within each opening 27. One way valve 31 often takes the form of a so-called "mushroom valve" which operates so as to keep gases traveling in one direction only. One way valve 31 is biased so as to be normally in an open, free air flow configuration.

It should be understood that some or all of top panel 4, internal barrier panel 5, bottom panel 6, top perimeter band 8, bottom perimeter band 10, and plurality of baffle-panels 11 are most often, but not always formed from a sheet of fabric, e.g., nylon scrim or the like, and may be coated on at least its outer surface with a water proof coating. The water proof coating may be any of the well known polymeric or elastomeric compounds that are known to be impervious to semi-solids and liquids, such as, blood, urine, feces, hospital strength disinfecting compounds, alcohol, or the like. For example, a nylon twill fabric that is coated on one side with a heat sealable, polyurethane coating (e.g., an inner side) and the outer side coated with a Durable Water Repellant (Patient side). A practical benefit associated with the use of the foregoing preferred materials is that double chambered transfer mattress 2 retains a better appearance for longer periods of time during use. A double coated double chambered transfer mattress 2 can be easily wiped down, and can be put back into use more quickly.

Alternatively, in those instances where a single use, single patient mattress is provided, i.e., where patient use lasting less than twenty four hours is desired, some or all of top panel 4, internal barrier panel 5, bottom panel 6, top perimeter band 8, bottom perimeter band 10, and plurality of baffle-panels 11 may be formed from fibers for forming fabrics suitable for single use top panel 4 may be made of materials, such as, acetate, acrylic, anidex, aramid, azlon, cotton, elastoester, fluorocarbon, fur, glass, lyocell, melamine, metallic, modacrylic, modal, mosacrylic, novoloid, nylon, nytril, olefin, PAN, PBI, PEEK, Pelco, PEN, PLA, PTT, polyester, polyester-polyarylate, rayon, saran, spandex, sulfar, triacetate, vinal, vinyon, and wool. A common characteristic of the foregoing and like materials is their propensity to stain or discolor as a result of contact with blood, urine, feces, hospital strength disinfecting compounds, alcohol, or the like. Additionally, a variety of films may be used to form a single patient, single use double chambered transfer mattress 2, for example, copolyester, copolyether, ethylene vinyl acetate, fluorocarbon, polyamide, olefins, polybutylene, polycarbonate, polyester, polystyrene, polyurethane, polyvinyl, alcohol, polyvinyl chloride, polyvinyl fluoride, and polyvinylidene chloride. A practical benefit associated with the use of the foregoing preferred materials is that double chambered transfer mattress 2 retains a stained and discolored appearance for longer periods of time after use thereby alerting hospital staff or other care givers that a particular double chambered transfer mattress 2 has completed its useful life, and must be discarded.

In one embodiment, some or all of top panel 4, internal barrier panel 5, bottom panel 6, top perimeter band 8, bottom perimeter band 10, and plurality of baffle-panels 11 may comprise a cold water soluble partially hydrolyzed polyvinyl alcohol, cold water insoluble hot water disintegrable aliphatic polyester, and minor proportions of processing and performance aids. The aliphatic polyester has a melt temperature above the normal body temperature of a human (37 degrees C.; 98.6 degrees F.) and is present in the resin blend at a concentration sufficient to constitute the continuous phase of the blend, with the polyvinyl alcohol constituting a discontinuous phase of the blend. The aliphatic polyester renders the resin blend, and the partially hydrolyzed polyvinyl alcohol in the blend is, cold water insoluble and determines the temperature at which articles formed from the blend will be subject to dissolution in an aqueous bath and subsequent disposal. A practical benefit associated with the use of the foregoing material is that double chambered transfer mattress 2 not only retains a stained and discolored appearance for longer periods of time after use, thereby alerting hospital staff or other care givers that a particular double chambered transfer mattress 2 has completed its useful life, and must be discarded, but also if an attempt is made to launder the mattress after a single use it disintegrates during the washing process.

Bottom panel 6 comprises a head portion 22, a foot portion 24, and a peripheral edge 26. Bottom panel 6 includes a plurality of tiny holes 30 that are defined through its thickness to allow air, that is supplied by a high-pressure air supply to double chambered transfer mattress 2, via an air supply hose 34, to escape in a controlled manner. The air supplied to double chambered transfer mattress 2 escapes through plurality of holes 30, providing a weight-bearing cushion of air that facilitates the sliding of double chambered transfer mattress 2 along a surface, as well as, from one surface to another.

Top perimeter band 8 and a bottom perimeter band 10 often take the form of elongate, rectangular strips of any of the foregoing materials. Top perimeter band 8 is sealingly fastened between peripheral edge 16 of top panel 4 and peripheral edge 20 of barrier panel 5, e.g., by heat sealing, gluing or sewing, so as to form a first chamber 35. Bottom perimeter band 10 is sealingly fastened between peripheral edge 20 of barrier panel 5 and peripheral edge 26 of bottom panel 6, so as to form a second chamber 37.

Plurality of baffle-panels 11 each comprise substantially rectangular sheets of nylon scrim or the like, and include a top edge 40 and a bottom edge 42. Baffle-panels 11 may have differing widths, depending upon their position within double chambered transfer mattress 2. Two sets of baffle panels 11 are installed within double chambered transfer mattress 2, a first set of baffle panels 11 is located in first chamber 35 and a second set of baffle panels 11 is located in a second chamber 37. For the first set on baffle panels 11, each top edge 40 is fastened transversely to a portion of inner surface 19 of top panel 4 and each bottom edge 42 is fastened transversely to a portion of inner surface 20 of barrier panel 5. For the second set of baffle panels 11, each top edge 40 is fastened transversely to a portion of inner surface 21 of barrier panel 5 and each bottom edge 42 is fastened transversely to a portion of inner surface 29 of bottom panel 6.

An inlet/outlet opening 50 is formed in perimeter band 8 that sealingly accepts an air supply hose 34. Inlet opening 50 is sized and shaped so that air supply hose 34 may be inserted, with the inlet being thereafter snapped shut or otherwise closed to hold air supply hose 34 in place while double chamber transfer mattress 2 is being inflated. Inlet openings 50 may also include a valve (not shown) that is biased to be normally closed to prevent air from exiting through the inlet, and opened when air supply hose 34 is inserted into inlet opening 50. Other arrangements known to those skilled in the art may be used to inflate double chambered transfer mattress 2.

A double chambered transfer mattress 2 is assembled according to the present invention in the following manner. Bottom panel 6 is laid out on a suitable support surface so that second set of baffle-panels 11 may be transversely arranged in the center section of inner surface 29. Once in this position, bottom edge 42 of each baffle-panel 11 is fixedly fastened to inner surface 29 of bottom panel 6. Baffle-panels 11 are advantageously heat sealed along the interface between bottom edge 42 and inner surface 29 of bottom panel 6. This heat sealing may be done with the application of heat or ultra sonic energy at the edge interface. In this way, a re-solidified interface structure is formed so as to improve the bond and its resistance to rupture under normal loading.

Once second set of baffle-panels 11 are fastened to inner surface 29 of bottom panel 6, barrier panel 5 is arranged in overlying confronting relation with bottom panel 6 so that head portion 17 of barrier panel 5 is confronting head portion 22 of bottom panel 6 and foot portion 19 of barrier panel 5 is confronting foot portion 24 of bottom panel 6. Once in this position, each top edge 40 of each baffle-panel 11 is fixedly fastened to inner surface 21 of barrier panel 5.

At this point in the assembly, top panel 4 is arranged in overlying confronting relation with barrier panel 5 so that head portion 12 of top panel 4 is confronting head portion 17 of barrier panel 5 and foot portion 14 of top panel 4 is confronting foot portion 19 of barrier panel 5. Once in this position, second set of baffle panels 11 may be assembled by fixedly fastening each top edge 40 of each baffle-panel 11 to inner surface 29 of top panel 4 and each bottom edge 42 of each baffle-panel 11 is fixedly fastened to inner surface 20 of barrier panel 5. Top and bottom perimeter bands 8 and 10 are then sealingly fastened to peripheral edge 16 of top panel 4, peripheral edge 20 of barrier panel 5 and peripheral edge 26 of bottom panel 6 so as to complete construction of double chambered transfer mattress 2.

Double chambered transfer mattress 2 is used when positioning a patient for X-ray photography in the following manner. The patient (not shown) is positioned atop outer surface 18 so that the patient's head is resting adjacent to head portion 12 atop panel 4. Double chambered transfer mattress 2 is inflated by passing high pressure air through opening 50 in top perimeter band 8. As the high pressure air enters first chamber 35 it passes through one-way valve 31 disposed in opening 27 so as to also pressurize second chamber 37. Once first chamber 35 and second chamber 37 are fully inflated, with air flowing through holes 30 so as to effect the cushion of air necessary for transfer of the patient, double chamber transfer mattress 2 is shifted laterally from a gurney or table onto the table in the X-ray theater. Once in this position, the source of high pressure air connected to opening 50 in top perimeter band 8 is shut-off, and inlet/outlet opening 50 is closed so that pressurized air continues to escape only through holes 30 in bottom panel 6. As the air escapes second chamber 37, one-way valve 31 is biased closed as barrier panel 5 moves toward bottom panel 6. In this way, air escaping from first chamber 35 is stopped by one-way valve 31. As a consequence, the patient is comfortably positioned on top panel 4 while the X-ray is taken. Once the X-ray procedure is completed air is reintroduced into double chamber transfer mattress 2 so as to reinflate second chamber 37 and reopen one-way valve 31. Once second chamber 37 has been inflated with air flowing through holes 30, double chamber transfer mattress 2 and the patient may be shifted from the X-ray table onto the gurney for removal from the X-ray theater.

It is to be understood that the present invention is by no means limited only to the particular constructions herein disclosed and shown in the drawings, but also comprises any modifications or equivalents within the scope of the claims.

What is claimed is:

1. A transfer mattress comprising:

at least one top inflatable mattress having an inlet/outlet valve arranged for air flow communication between an interior chamber of said at least one top inflatable mattress and a source of pressurized air;

a bottom inflatable mattress separate from said at least one top inflatable mattress and including a plurality of holes; and a closeable valve positioned in flow communication between said at least one top inflatable mattress and said bottom inflatable mattress so as to provide selective air flow between said at least one top inflatable mattress and said bottom inflatable mattress so that when said inlet/outlet valve is closed-off from said source of pressurized air, said bottom inflatable mattress deflates by air escaping through said plurality of holes whereby said closeable valve is closed so as to prevent deflation of said at least one top inflatable mattress.

2. A transfer mattress according to claim 1 wherein said closeable valve is biased so as to be normally in an open, free air flow configuration.

3. A transfer mattress according to claim 1 wherein at least one of said top inflatable mattress and said bottom inflatable mattress is formed from one or more fabrics selected from the group consisting of acetate, acrylic, anidex, aramid, azlon, cotton, elastoester, fluorocarbon, fur, glass, lyocell, melamine, metallic, modacrylic, modal, mosacrylic, novoloid, nylon, nytril, olefin, PAN, PBI, PEEK, Pelco, PEN, PLA, PTT, polyester, polyester-polyarylate, rayon, saran, spandex, sulfar, triacetate, vinal, vinyon, and wool.

4. A transfer mattress according to claim 1 wherein at least one of said top inflatable mattress and said bottom inflatable mattress is formed from one or more films selected from the group consisting of copolyester, copolyether, ethylene vinyl acetate, fluorocarbon, polyamide, olefins, polybutylene, polycarbonate, polyester, polystyrene, polyurethane, polyvinyl, alcohol, polyvinyl chloride, polyvinyl fluoride, and polyvinylidene chloride.

5. A transfer mattress according to claim 1 wherein at least one of said top inflatable mattress and said bottom inflatable mattress is formed from one or more fabrics which comprise a cold water soluble partially hydrolyzed polyvinyl alcohol, cold water insoluble hot water disintegrable aliphatic polyester.

6. A transfer mattress according to claim 1 wherein at least one of said top inflatable mattress and said bottom inflatable mattress is formed from an aliphatic polyester that has a melt temperature above a normal human body temperature and is present in a resin blend at a concentration sufficient to constitute the continuous phase of the blend, with a polyvinyl alcohol constituting a discontinuous phase of the blend, wherein said aliphatic polyester renders said resin blend, and a partially hydrolyzed polyvinyl alcohol in the blend cold water insoluble and determines a temperature at which said at least one of said top inflatable mattress and said bottom inflatable mattress formed from said blend will be subject to dissolution in an aqueous bath.

7. A transfer mattress comprising:

a top inflatable mattress defined by a top sheet and a perimeter band having an inlet/outlet valve arranged for air flow communication between an interior chamber of said top inflatable mattress and a source of pressurized air;

a bottom inflatable mattress including a bottom sheet defining a plurality of holes and a perimeter band wherein said top inflatable mattress and said bottom inflatable mattress are separate; and a closeable valve positioned between said top inflatable mattress and said bottom inflatable mattress so as to provide air flow communication between said top inflatable mattress and said bottom inflatable mattress so that when said inlet/outlet valve is closed-off from said source of pressurized air, said bottom inflatable mattress deflates by air escaping through said plurality of holes whereby said closeable valve is biased closed so as to prevent deflation of said top inflatable mattress.

* * * * *